US009371808B2

(12) United States Patent
Hashii

(10) Patent No.: US 9,371,808 B2
(45) Date of Patent: Jun. 21, 2016

(54) FUEL INJECTION VALVE

(71) Applicant: Naoya Hashii, Tokyo (JP)

(72) Inventor: Naoya Hashii, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/420,824

(22) PCT Filed: Oct. 23, 2012

(86) PCT No.: PCT/JP2012/077341

§ 371 (c)(1),
(2) Date: Feb. 10, 2015

(87) PCT Pub. No.: WO2014/064766

PCT Pub. Date: May 1, 2014

(65) Prior Publication Data

US 2015/0233333 A1 Aug. 20, 2015

(51) Int. Cl.

| | |
|---|---|
| ***B05B 1/30*** | (2006.01) |
| ***F02M 61/18*** | (2006.01) |
| ***F02M 61/04*** | (2006.01) |

(52) U.S. Cl.

CPC ..... *F02M 61/186* (2013.01); *F02M 61/04* (2013.01); *F02M 61/1813* (2013.01)

(58) Field of Classification Search

CPC ... F02M 61/18; F02M 61/06; F02M 61/1866; F02M 61/1893

USPC ..... 239/585.1, 585.3, 585.4, 585.5, 533.14, 239/596

See application file for complete search history.

(56) References Cited

U.S. PATENT DOCUMENTS 6,499,674 B2 * 12/2002 Ren ..... F02M 69/047 239/407
6,616,072 B2 * 9/2003 Harata ..... F02M 51/0678 239/533.12
7,066,408 B2 * 6/2006 Sugimoto ..... F02M 61/162 239/461

(Continued)

FOREIGN PATENT DOCUMENTS

JP 10-281040 A 10/1998
JP 11-200998 A 7/1999

(Continued)

OTHER PUBLICATIONS

International Search Report for PCT/JP2012/077341 dated Jan. 15, 2013.

*Primary Examiner* — Davis Hwu
(74) *Attorney, Agent, or Firm* — Sughrue Mion, PLLC; Richard C. Turner

(57) ABSTRACT

In a fuel injection valve, a thin portion that is formed so as to make a downstream hollow in an upstream end surface of a first spraying aperture plate is disposed on the first spraying aperture plate. First spraying apertures that are disposed on the thin portion are perpendicular to the first spraying aperture plate. L/d of the first spraying apertures is less than 1, where L is axial length, and d is diameter. Second spraying apertures on a second spraying aperture plate are inclined relative to an axis that is perpendicular to the second spraying aperture plate. An aperture area of an outlet portion of the first spraying apertures is smaller than an aperture area of the inlet portion of the second spraying apertures. An entire outlet opening of the first spraying apertures is disposed inside an inlet opening of the second spraying apertures.

9 Claims, 12 Drawing Sheets

(56) References Cited

U.S. PATENT DOCUMENTS

| | | | | |
|---|---|---|---|---|
| 7,124,963 | B2 * | 10/2006 | Goenka | B05B 1/14 239/504 |
| 8,567,701 | B2 * | 10/2013 | Hashii | F02M 51/0682 239/490 |
| 2002/0092930 | A1 | 7/2002 | Itatsu | |
| 2006/0097082 | A1 * | 5/2006 | Goenka | F02M 61/1806 239/533.14 |
| 2010/0288857 | A1 | 11/2010 | Hashii et al. | |
| 2011/0073683 | A1 | 3/2011 | Hashii et al. | |

FOREIGN PATENT DOCUMENTS

| | | | |
|---|---|---|---|
| JP | 2001-317431 | A | 11/2001 |
| JP | 2002-210392 | A | 7/2002 |
| JP | 2004-169572 | A | 6/2004 |
| JP | 2005-127186 | A | 5/2005 |
| JP | 2007-040111 | A | 2/2007 |
| JP | 2009-250122 | A | 10/2009 |
| JP | 2010-265865 | A | 11/2010 |
| JP | 2011-074778 | A | 4/2011 |
| JP | 2012-097642 | A | 5/2012 |

* cited by examiner

FUEL INJECTION VALVE

CROSS REFERENCE TO RELATED APPLICATIONS

This application is a National Stage of International Application No. PCT/JP2012/077341 filed Oct. 23, 2012, the contents of all of which are incorporated herein by reference in their entirety.

TECHNICAL FIELD

The present invention relates to a fuel injection valve that is used to supply fuel to an internal combustion engine of an automobile, etc., and particularly relates to a fuel injection valve that aims to achieve atomization promotion in spraying characteristics.

BACKGROUND ART

In recent years, as fuel consumption restrictions and exhaust emission regulations for automobiles, etc., are augmented, there is demand for atomization of fuel sprays that are sprayed from fuel injection valves. Because of that, in conventional fuel injection valves, a spraying aperture that sprays fuel is constituted by: a first cylindrical aperture; and a second cylindrical aperture that is disposed consecutively downstream from the first cylindrical aperture. The second cylindrical aperture has a larger diameter than the first cylindrical aperture, and is inclined at a predetermined angle relative to a central axis of the first cylindrical aperture (see Patent Literature 1, for example).

In other conventional fuel injection valves, a guiding portion that guides fuel flow toward inner circumferential inner wall surfaces of a spraying aperture is formed on an inlet-side opening edge of the spraying aperture at least near an outer peripheral side. Because of that, fuel that reaches a vicinity of the outer peripheral inner wall surface of the inlet-side opening edge of the spraying aperture is subjected to a guiding action of the guiding portion and is led to the inner circumferential inner wall surfaces of the spraying aperture. Thus, because the spraying aperture is inclined away from a central axis of a spraying aperture plate, the fuel that reaches the inner circumferential inner wall surfaces of the spraying aperture is formed into a liquid film by flowing over the inner wall surfaces of the spraying aperture, and is atomized by spraying (see Patent Literature 2, for example).

In addition, in conventional fluid injection nozzles, a spraying aperture plate is constituted by two pieces, i.e., an upper spraying aperture plate and a lower spraying aperture plate. Upstream spraying apertures are disposed on the upper spraying aperture plate so as to be parallel to a plate thickness direction thereof. In addition, tapered downstream spraying apertures are disposed on the lower spraying aperture plate. Aperture diameters d2 of the upstream spraying apertures are less than or equal to inlet-side aperture diameters d3 of the downstream spraying apertures. Thus, improvements in atomization can be achieved by the downstream spraying apertures while forming the upstream spraying apertures, which are easy to machine, precisely to ensure flow rate precision (see Patent Literature 3, for example).

CITATION LIST

Patent Literature

[Patent Literature 1]

Japanese Patent Laid-Open No. 2004-169572 (Gazette)

[Patent Literature 2]

Japanese Patent Laid-Open No. 2005-127186 (Gazette)

[Patent Literature 3]

Japanese Patent Laid-Open No. 2001-317431 (Gazette, FIG. 13)

SUMMARY OF THE INVENTION

Problem to be Solved by the Invention

However, in the conventional fuel injection valve that is disclosed in Patent Literature 1, the shape of the flow channel upstream from the first cylindrical aperture is not defined. Because of that, in order to form the liquid film on the inner walls of the second cylindrical aperture only by the relative angle and the size relationship of the aperture diameters of the first and second cylindrical apertures without being dependent on the shape of the upstream flow channel, it is necessary to lengthen the first cylindrical aperture such that the upstream flow has no effect.

In an environment of high temperature and negative pressure, the fuel boils due to decompression from a valve seat portion, where the flow channel is constricted, downstream to the first cylindrical aperture, forming a gas-liquid two-phase flow. Because of that, pressure loss when passing through the first cylindrical aperture is greater than for a liquid single-phase flow, reducing the spray rate. In particular, because the pressure loss is further increased if the first cylindrical aperture is lengthened as described above, one problem that remains is that the spray rate changes significantly depending on temperature and ambient pressure.

In the conventional fuel injection valve that is disclosed in Patent Literature 2, because it is necessary to lengthen the guiding portion in a similar or identical manner to that of Patent Literature 1 in order to direct the fuel more reliably toward the inner circumferential inner wall surfaces of the spraying aperture, one problem that remains is that the spray rate changes significantly depending on temperature and ambient pressure.

Furthermore, the spraying aperture plate is constituted by an upstream plate and a downstream plate, and the guiding portion that is formed on the upstream plate has a circular tapered aperture shape in which flow channel area is increasingly constricted toward a downstream end. In addition, the upstream end edge of the spraying aperture that is formed on the downstream plate (the spraying aperture downstream portion) has a larger diameter than the downstream end edge of the spraying aperture that is formed on the upstream plate (the spraying aperture upstream portion, i.e., the guiding portion). Because of that, the construction regulates the flow rate at the guiding portion, but because the flow channel area of the guiding portion is increasingly constricted toward a downstream end, the downstream opening diameter of the guiding portion, where the flow channel cross section is smallest, is susceptible to irregularities during machining, and another problem that remains is that the spray rate is more likely to be irregular.

In the conventional fluid injection nozzle that is disclosed in Patent Literature 3, the length of the upstream spraying apertures are shortened by forming the upstream spraying apertures in a plate thickness direction of the upper spraying aperture plate, but in order to atomize it is necessary to reduce the spraying aperture diameter while increasing the number of spraying apertures in the upstream spraying aperture. However, because the spray rate changes significantly depending on the temperature or the ambient pressure if the spraying aperture L/d, which is the ratio between the spraying aperture length L and the spraying aperture diameter d, is increased together with reductions in the diameter of the spraying apertures, a need arises to reduce the plate thickness of the upper spraying aperture plate.

At the same time, methods in which a strip-shaped hoop material is fed and pressed progressively are often used as methods for machining the upper spraying aperture plate in order to machine precisely at reduced cost. However, if the plate thickness of the upper spraying aperture plate, i.e., the sheet thickness of the hoop material, is thin, then there may be insufficient rigidity, and one problem has been that wrinkles form in the hoop material as the hoop material is fed progressively, preventing progressive feeding to the correct position, and giving rise to processing problems.

Furthermore, the downstream spraying apertures that are disclosed in Patent Literature 3 are tapered apertures in which flow channel area widens increasingly toward a downstream end, and it is difficult to stabilize the shape because axial stroke management is required during machining. Because of that, irregularities are more likely to occur in the flow as the liquid film stretches over the inner walls of the downstream spraying apertures, and one problem has been that the spray shape that is sprayed from the spraying apertures is more likely to become irregular.

The present invention aims to solve the above problems and an object of the present invention is to provide a fuel injection valve that can achieve atomization of sprayed fuel at reduced cost while suppressing changes in spray rate due to temperature and ambient pressure.

Means for Solving the Problem

In order to achieve the above object, according to one aspect of the present invention, there is provided a fuel injection valve including: a valve seat including: a seat surface that is inclined such that a diameter is gradually reduced downstream; and a valve seat opening that is disposed downstream from the seat surface; a valve body that is placed in contact with the seat surface to stop outflow of fuel from the valve seat opening, and that is separated from the seat surface to allow outflow of fuel from the valve seat opening; and a spraying aperture plate that is fixed to a downstream end surface of the valve seat, and that includes a plurality of spraying apertures that externally spray fuel that flows out of the valve seat opening, wherein: the spraying aperture plate is disposed such that an imaginary circular conical surface that is a downstream extension of the seat surface and an upstream end surface of the spraying aperture plate intersect to form an imaginary circle; the spraying aperture plate is configured by laminating an upstream first spraying aperture plate and a downstream second spraying aperture plate; a thin portion that is formed so as to make a downstream hollow in an upstream end surface of the first spraying aperture plate is disposed on a portion of the first spraying aperture plate that faces into the valve seat opening; a plurality of first spraying apertures that constitute upstream portions of the spraying apertures are disposed on the thin portion; a plurality of second spraying apertures that constitute downstream portions of the spraying apertures are disposed on the second spraying aperture plate; the first spraying apertures are perpendicular to the first spraying aperture plate; L/d of the first spraying apertures is less than 1, where L is axial length, and d is diameter; the second spraying apertures are inclined at a predetermined angle relative to an axis that is perpendicular to the second spraying aperture plate; when the second spraying apertures are projected perpendicularly onto a plane that is perpendicular to a central axis of the valve seat, a center of an outlet portion of the second spraying apertures in the plane is disposed further away from the central axis of the valve seat than a center of an inlet portion of the second spraying apertures; an aperture area of an outlet portion of the first spraying apertures is smaller than an aperture area of the inlet portion of the second spraying apertures; and an entire outlet opening of the first spraying apertures is disposed inside an inlet opening of the second spraying apertures.

According to another aspect of the present invention, there is provided a fuel injection valve including: a valve seat including: a seat surface that is inclined such that a diameter is gradually reduced downstream; and a valve seat opening that is disposed downstream from the seat surface; a valve body that is placed in contact with the seat surface to stop outflow of fuel from the valve seat opening, and that is separated from the seat surface to allow outflow of fuel from the valve seat opening; and a spraying aperture plate that is fixed to a downstream end surface of the valve seat, and that includes a plurality of spraying apertures that externally spray fuel that flows out of the valve seat opening, wherein: the spraying aperture plate is disposed such that an imaginary circular conical surface that is a downstream extension of the seat surface and an upstream end surface of the spraying aperture plate intersect to form an imaginary circle; the spraying aperture plate is configured by laminating an upstream first spraying aperture plate and a downstream second spraying aperture plate; a plurality of first spraying apertures that constitute upstream portions of the spraying apertures are disposed on the first spraying aperture plate; an inlet portion of the first spraying apertures is disposed nearer to a central axis of the valve seat than the valve seat opening, where a diameter is smallest in the valve seat; a plurality of second spraying apertures that constitute downstream portions of the spraying apertures are disposed on the second spraying aperture plate; the first spraying apertures are constituted by: a cylinder portion in which flow channel cross-sectional area is constant over an entire longitudinal direction; and a flow channel enlarged portion that is adjacent downstream from the cylinder portion, and in which flow channel cross-sectional area is enlarged gradually downstream; L/d of the first spraying apertures is less than 1, where L is axial length, and d is diameter; the second spraying apertures are inclined at a predetermined angle relative to an axis that is perpendicular to the second spraying aperture plate; when the second spraying apertures are projected perpendicularly onto a plane that is perpendicular to a central axis of the valve seat, a center of an outlet portion of the second spraying apertures in the plane is disposed further away from the central axis of the valve seat than a center of an inlet portion of the second spraying apertures; an aperture area of an outlet portion of the first spraying apertures is smaller than an aperture area of the inlet portion of the second spraying apertures; and an entire outlet opening of the first spraying apertures is disposed inside an inlet opening of the second spraying apertures.

Effects of the Invention

The fuel injection valve according to the present invention can achieve atomization of sprayed fuel at reduced cost while suppressing changes in spray rate due to temperature and ambient pressure.

DESCRIPTION OF EMBODIMENTS

Embodiments for implementing the present invention will now be explained with reference to the drawings.

Embodiment 1

Figure 1:
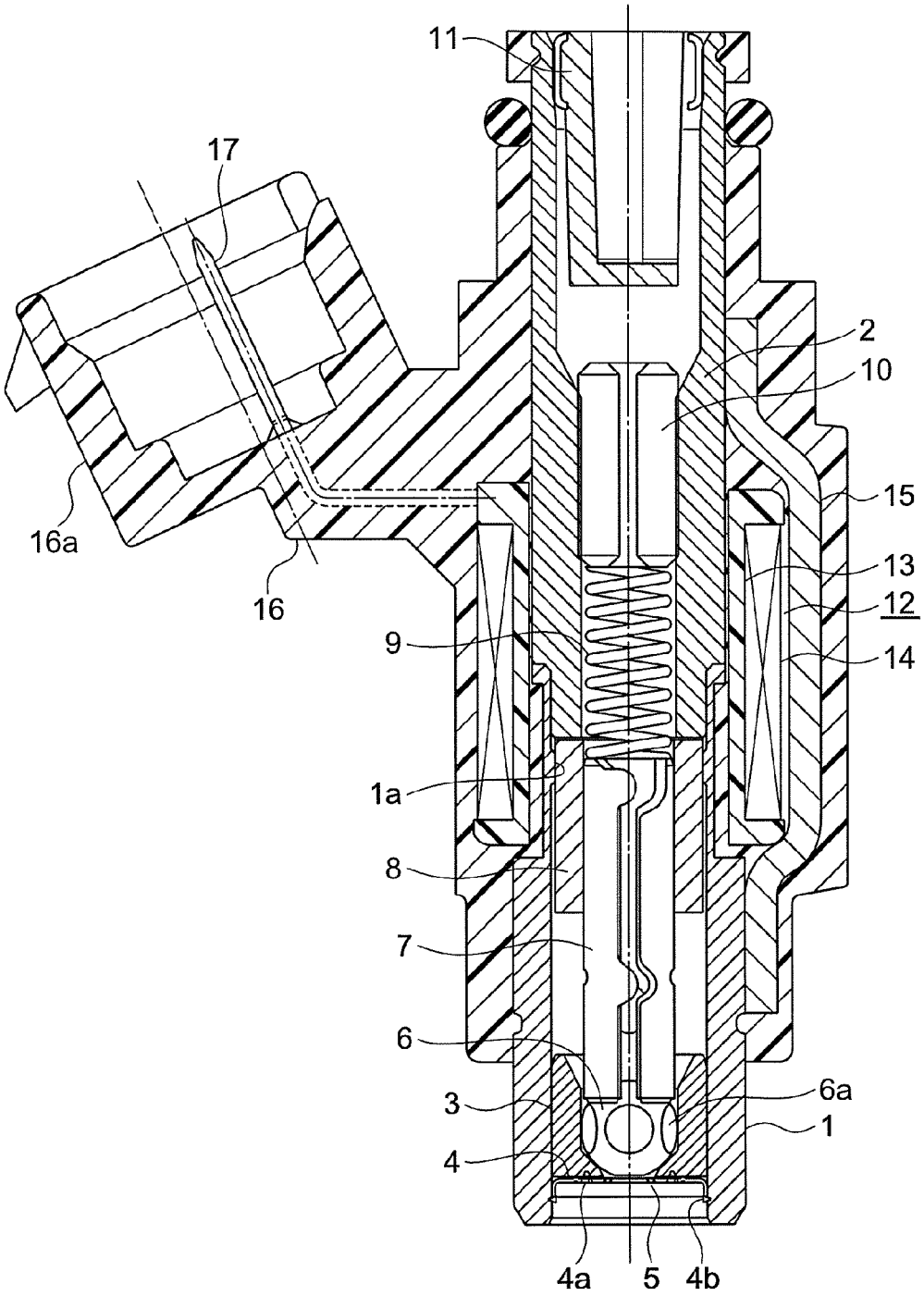
FIG. 1 is a cross section parallel to a shaft axis of a fuel injection valve according to Embodiment 1 of the present invention.

FIG. 1 is a cross section parallel to a shaft axis of a fuel injection valve according to Embodiment 1 of the present invention, and fuel flows downward from an upper end of the fuel injection valve in FIG. 1. In the figure, a cylindrical fixed core 2 is fixed to an upper end portion of a magnetic pipe 1. The magnetic pipe 1 and the fixed core 2 are disposed coaxially. The magnetic pipe 1 is press-fitted onto a downstream end portion of the fixed core 2 and is welded.

A valve seat 3 and a spraying aperture plate 4 are fixed to a lower end portion inside the magnetic pipe 1. A plurality of spraying apertures 5 that spray fuel are disposed on the spraying aperture plate 4. The spraying apertures 5 pass through the spraying aperture plate 4 in a plate thickness direction.

The spraying aperture plate 4 is fixed to a downstream end surface of the valve seat 3 by a plurality of first weld portions 4*a*, is inserted into the magnetic pipe 1 in that state, and is then fixed to the magnetic pipe 1 by a second weld portion 4*b*.

Inserted inside the magnetic pipe 1 are: a ball 6 that constitutes a valve body; a needle pipe 7 that is fixed by welding onto the ball 6; and an armature (a movable core) 8 that is fixed to an upstream end portion (an end portion at an opposite end from the ball 6) of the needle pipe 7. The armature 8 is press-fitted into the upstream end portion of the needle pipe 7 and is welded.

The armature 8 is slidable in an axial direction inside the magnetic pipe 1. A guiding portion 1*a* that guides the sliding movement of the armature 8 is disposed on an inner circumferential surface of the magnetic pipe 1. The needle pipe 7 and the armature 8 move together in the axial direction when the armature 8 slides. The ball 6 is thereby placed in contact with or separated from the valve seat 3. An upper end surface of the armature 8 is also placed in contact with or separated from a lower end surface of the fixed core 2. Chamfered portions 6*a* are disposed on an outer circumference of the ball 6.

A compression spring 9 that presses the needle pipe 7 in a direction that pushes the ball 6 against the valve seat 3 is inserted inside the fixed core 2. An adjuster 10 that adjusts the load of the compression spring 9 is also fixed inside the fixed core 2. In addition, a filter 11 is inserted into an upper end portion of the fixed core 2, which constitutes a fuel inlet portion.

An electromagnetic coil 12 is fixed onto an outer circumference of a downstream end portion (an end portion near the armature 8) of the fixed core 2. The electromagnetic coil 12 has: a resin bobbin 13; and a coil main body 14 that is wound onto an outer circumference thereof. A metal sheet (a magnetic circuit component member) 15 that constitutes a yoke portion of a magnetic circuit is fixed by welding between the magnetic pipe 1 and the fixed core 2.

The magnetic pipe 1, the fixed core 2, the electromagnetic coil 12, and the metal sheet 15 are molded integrally into a resin housing 16. A connector portion 16*a* is disposed on the resin housing 16. Terminals 17 that are electrically connected to the coil main body 14 are led out into the connector portion 16*a*.

Figure 2:
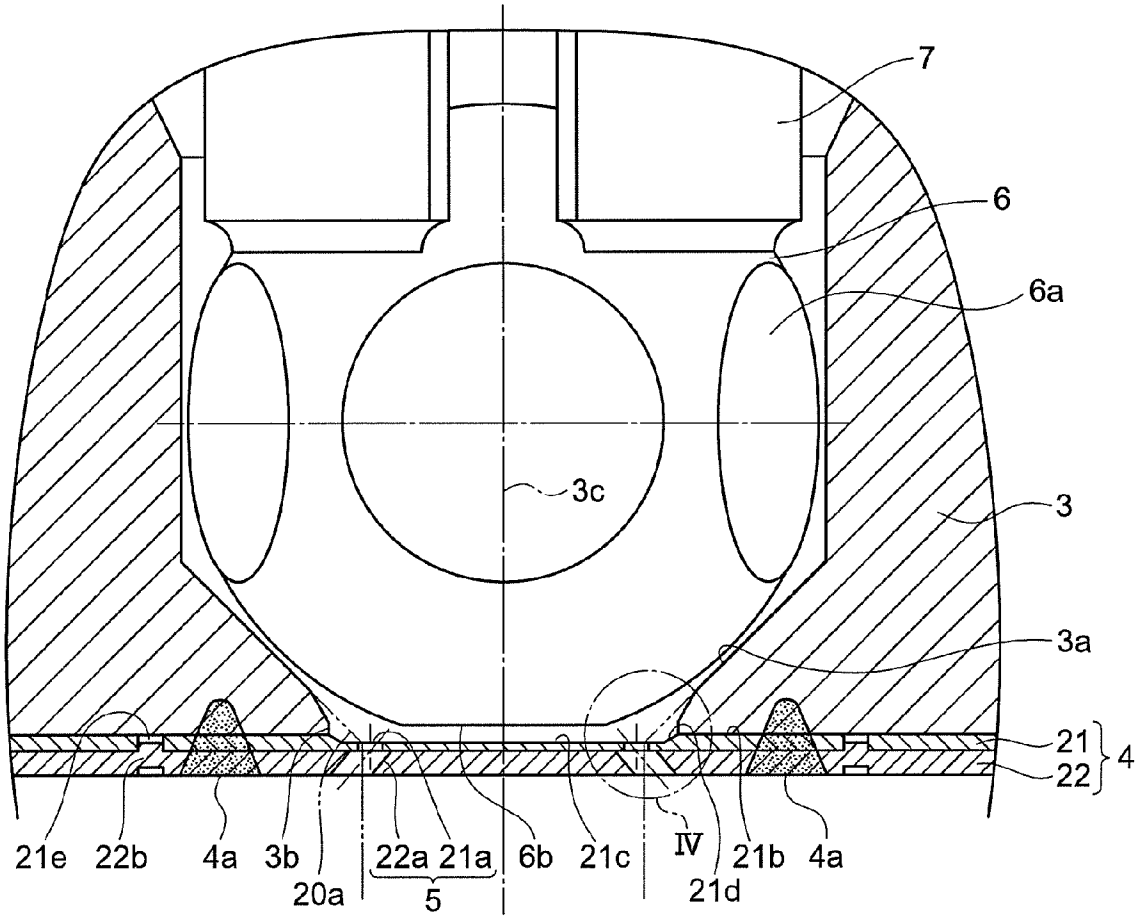
FIG. 2 is a cross section that shows a valve seat, a spraying aperture plate, and a ball from FIG. 1 enlarged.
Figure 3:
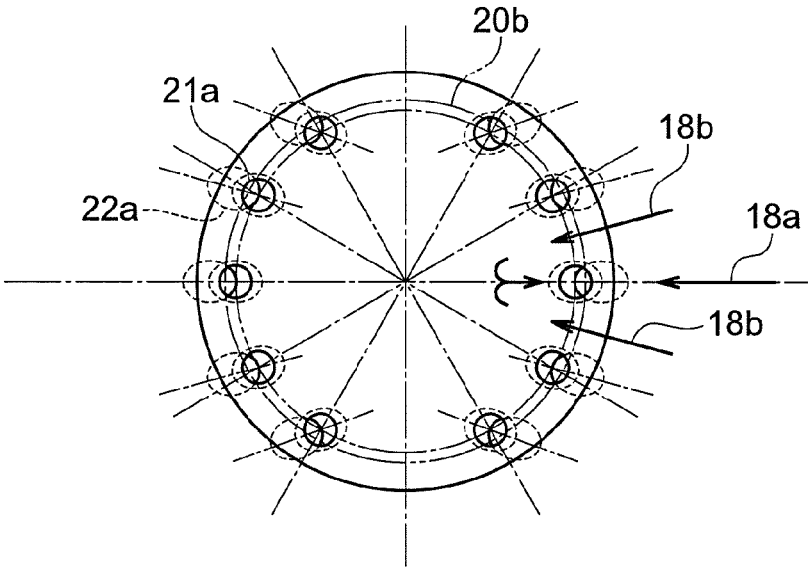
FIG. 3 is a plan that shows a central portion of the spraying aperture plate from FIG. 2.

FIG. 2 is a cross section that shows the valve seat 3, the spraying aperture plate 4, and the ball 6 from FIG. 1 enlarged, and FIG. 3 is a plan (a view of a portion that is exposed to the fuel flow channel from a side near the ball 6) that shows a central portion of the spraying aperture plate 4 from FIG. 2.

A seat surface 3*a* on which the ball 6 is separably placed in contact is disposed inside the valve seat 3. The seat surface 3*a* is inclined such that a diameter thereof is gradually reduced downstream. A circular valve seat opening 3*b* that faces the spraying aperture plate 4 is also disposed centrally on the downstream end portion of the valve seat 3 at a downstream end of the seat surface 3*a*.

The ball 6 is placed in contact with the seat surface 3*a* to stop outflow of fuel from the valve seat opening 3*b*, and is separated from the seat surface 3*a* to allow outflow of fuel from the valve seat opening 3*b*. The spraying aperture plate 4 is disposed such that an imaginary circular conical surface 20*a* (FIG. 2) that is a downstream extension of the seat surface 3*a* and an upstream end surface of the spraying aperture plate 4 intersect to form an imaginary circle 20*b* (FIG. 3).

The spraying aperture plate 4 is configured by laminating an upstream first spraying aperture plate 21 and a downstream second spraying aperture plate 22. A plurality of first spraying apertures 21*a* are disposed on the first spraying aperture plate 21. Second spraying apertures 22*a* that are equal in number to the first spraying apertures 21*a* are disposed on the second spraying aperture plate 22. The respective first spraying apertures 21*a* and the respective second spraying apertures 22*a* have one-to-one correspondence with each other, and are connected.

The first spraying apertures 21*a* constitute upstream portions of the spraying apertures 5, and the second spraying apertures 22*a* constitute downstream portions of the spraying apertures 5. In other words, the respective spraying apertures 5 are constituted by the first spraying apertures 21*a* and the second spraying apertures 22*a*.

Flow channel cross-sectional area of the first spraying apertures 21*a* and flow channel cross-sectional area of the second spraying apertures 22*a* are constant over their respective longitudinal directions. In Embodiment 1, the first spraying apertures 21*a* and the second spraying apertures 22*a* are both cylindrical, but the flow channel cross section may be elliptical or may be polygonal provided that the flow channel cross-sectional area of the spraying apertures is constant over the entire longitudinal direction.

The first spraying apertures 21*a* are disposed on the imaginary circle 20*b* so as to be spaced apart from each other circumferentially around the imaginary circle 20*b*. The inlet portions of the first spraying apertures 21*a* are disposed nearer to a valve seat central axis 3*c* than the valve seat opening 3*b*, where an inside diameter of the valve seat 3 is smallest. In addition, the first spraying apertures 21*a* are perpendicular to the first spraying aperture plate 21. In other words, the first spraying apertures 21*a* are disposed so as to be parallel to a plate thickness direction of the first spraying aperture plate 21.

The first spraying aperture plate 21 has: a thick portion 21*b*; and a thin portion 21*c* that is positioned centrally on the thick portion 21*b* and that has a smaller thickness dimension than the thick portion 21*b*. In Embodiment 1, the thin portion 21*c* is disposed on a portion that faces inside the valve seat opening 3*b* (near the valve seat central axis 3*c*), i.e., a portion that contacts the fuel.

The thin portion 21*c* is formed by pressing the upstream end surface of the first spraying aperture plate 21 downstream to make a hollow. A tapered portion 21*d* is formed between the thin portion 21*c* and the thick portion 21*b*. All of the first spraying apertures 21*a* are disposed on the thin portion 21*c* by pressing, and the range of the thin portion 21*c* may be smaller than or greater than the valve seat opening 3*b* provided that the inlet portions of the first spraying apertures 21*a* are disposed nearer to the valve seat central axis 3*c* than the valve seat opening 3*b*, where the inside diameter of the valve seat 3 is smallest.

A plurality of positioning apertures 21*e* are press-formed into the thick portion 21*b*. Half-blanked portions 22*b* that are fitted together with the positioning apertures 21*e* are press-formed into the second spraying aperture plate 22. The second spraying aperture plate 22 is positioned relative to the first spraying aperture plate 21 by fitting the half-blanked portions 22*b* into the positioning apertures 21*e*.

The second spraying apertures 22*a* are inclined at a predetermined angle relative to an axis that is perpendicular to the second spraying aperture plate 22. In other words, the second spraying apertures 22*a* are inclined relative to the first spraying apertures 21*a*.

An aperture area of outlet portions of the first spraying apertures 21*a* is smaller than an aperture area of inlet portions of the second spraying apertures 22*a*. In other words, the aperture area of the inlet portions of the second spraying apertures 22*a* is larger than the aperture area of the outlet portions of the first spraying apertures 21*a*. The second spraying apertures 22*a* are disposed such that inlet opening edges thereof do not cross the outlet opening edges of the first spraying apertures 21*a*. In other words, the outlet openings of the first spraying apertures 21*a* are disposed wholly inside the inlet openings of the second spraying apertures 22*a*.

A flat portion 6*b* that is parallel (or approximately parallel) to the upstream end surface of the first spraying aperture plate 21 is disposed on a tip end portion of a ball 6. Dead volume is thereby reduced in a portion that is surrounded by the inner walls of the valve seat 3 downstream from the seat surface 3*a*, the upstream end surface of the first spraying aperture plate 21, and the tip end portion of the ball 6, while avoiding interference between the tip end portion of the ball 6 and the spraying aperture plate 4 during valve closing.

Figure 4:
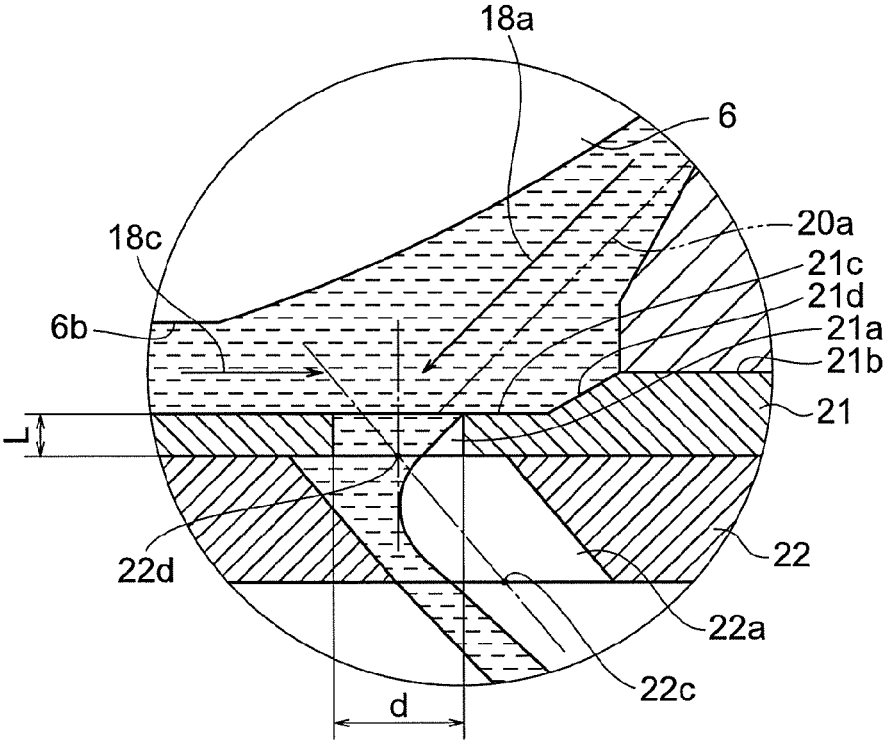
FIG. 4 is a cross section that shows Portion IV from FIG. 2 enlarged.

FIG. 4 is a cross section that shows Portion IV from FIG. 2 enlarged. An axial length L of the first spraying apertures 21*a* (a thickness of the thin portion 21*c*) is smaller than a diameter d of the first spraying apertures 21*a* (L/d<1). Centers 22*c* of the outlet portions of the second spraying apertures 22*a* are also disposed further away from the valve seat central axis 3*c* than centers 22*d* of the inlet portions of the second spraying apertures 22*a*. In other words, the second spraying apertures 22*a* are inclined such that the outlet portions are positioned radially further outward on the second spraying aperture plate 22 than the inlet portions.

Centers 22*d* of the inlet portions of the respective first spraying apertures 21*a* are disposed inside the imaginary circle 20*b*. In addition, the centers 22*d* of the inlet portions of the first spraying apertures 21*a* are disposed radially further outward than a portion of the first spraying aperture plate 21 that faces the flat portion 6*b*.

Next, operation of the fuel injection valve will be explained. When an actuating signal is sent by an engine controlling apparatus to a fuel injection valve driving circuit, an electric current is made to flow to the electromagnetic coil 12 through the terminals 17 such that magnetic flux arises in a magnetic circuit that is constituted by the armature 8, the fixed core 2, the metal sheet 15, and the magnetic pipe 1.

Thus, the armature 8 is attracted toward the fixed core 2, making the armature 8, the needle pipe 7, and the ball 6, which constitute an integrated construction, move upward in FIG. 1. Then, when the ball 6 separates from the valve seat 3 to form a gap between the ball 6 and the valve seat 3, fuel passes through the gaps between the chamfered portions 6*a* of the ball 6 and the valve seat 3, and is sprayed from the spraying apertures 5 into an engine air intake pipe.

Next, when an operation stopping signal is sent by the engine controlling apparatus to the fuel injection valve driving circuit, the passage of electric current to the electromagnetic coil 12 is stopped, magnetic flux in the magnetic circuit is reduced, and the armature 8, the needle pipe 7, and the ball 6 move downward in FIG. 1 due to the spring force from the compression spring 9. Thus, the gap between the ball 6 and the valve seat 3 is closed, completing fuel injection.

During fuel injection, as shown in FIG. 4, the flow 18*a* over the seat surface 3*a* toward a first spraying aperture 21*a* is separated at the inlet portion of the first spraying aperture 21*a*, and then collides with the inner wall on one side of the second spraying aperture 22*a* (on a radially inner side of the second spraying aperture plate 22). Here, because the flow channel cross-sectional area of the second spraying aperture 22*a* is larger than the flow channel cross-sectional area of the first spraying aperture 21*a*, the flow that starts to spread into a liquid film on the inner wall of the second spraying aperture 22*a* is augmented.

Moreover, because the fuel that is separated at the inlet portion of the first spraying aperture 21*a* is pushed against the inner wall on one side of the first spraying apertures 21*a* (a radially inner side of the first spraying aperture plate 21), a flat liquid film is formed in an identical direction to a direction in which the liquid film spreads over the second spraying apertures 22*a* at a stage before subsequently colliding into the inner wall of the second spraying aperture 22*a*. Formation of a thin film of fuel can thereby be achieved efficiently, enabling atomization of the sprayed fuel to be achieved.

Because the center 22*d* of the inlet portion of the first spraying aperture 21*a* is disposed inside the imaginary circle 20*b*, the flow 18*a* over the seat surface 3*a* toward the first spraying aperture 21*a* is separated at the inlet portion of the first spraying aperture 21*a* more reliably.

In addition, because the center 22*d* of the inlet portion of the first spraying aperture 21*a* is disposed radially further outward than the portion of the first spraying aperture plate 21 that faces the flat portion 6*b*, the flow 18*a* over the seat surface 3*a* toward the first spraying aperture 21*a* has a predetermined angle relative to the upstream end surface of the first spraying aperture plate 21. At the same time, the flow 18*b* that passes between adjacent first spraying apertures 21*a* (FIG. 3) collides with fuel that has flowed from the opposite side to the center of the first spraying aperture plate 21, and forms a back flow 18*c* toward the inlet portion of the first spraying aperture 21*a*, but the back flow 18*c* is a flow that is parallel to the upstream end surface of the first spraying aperture plate 21. Flow separation at the inlet portion of the first spraying aperture 21*a* is thereby augmented, enabling atomization to be further promoted.

In contrast to that, if the first spraying apertures 21*a* are disposed at positions that face the flat portion 6*b* (Patent Literature 2), flow separation augmenting effects cannot be achieved because the flow 18*a* and the flow 18*c* collide head-on.

Furthermore, at the commencement of spraying, because fuel inside a space (a dead volume) between the tip end portion of the ball 6 and the first spraying aperture plate 21 is discharged from the spraying apertures 5, spraying velocity is reduced compared to during steady spraying after completion of the valve opening operation of the ball 6. There is a tendency for spray particle size to be larger in the initial spray at the commencement of spraying than during steady spraying.

Figure 5:
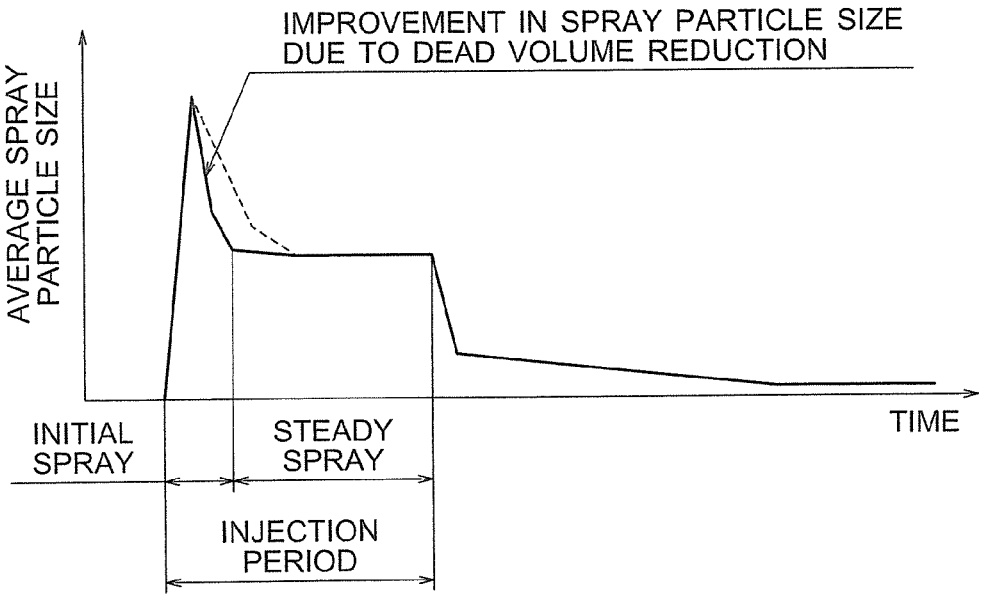
FIG. 5 is a graph that shows time variation in spray particle size during fuel injection by the fuel injection valve in FIG. 1.

In answer to that, in Embodiment 1, because dead volume is reduced, the amount of spraying of initial spray that has a larger particle size is reduced, enabling the overall spray particle size of both initial spray and steady spray to be reduced, as shown in FIG. 5.

Because the first spraying apertures 21*a* are perpendicular to the first spraying aperture plate 21, the shortest length of the first spraying apertures 21*a* can be set relative to the plate thickness of the first spraying aperture plate 21, i.e., L/d can be minimized. Because of that, even if the fuel becomes a gas-liquid two-phase flow in a high-temperature negative-pressure environment due to decompression boiling downstream from the valve seat 3 to the first spraying apertures 21*a*, the influence of pressure loss is reduced, enabling changes in spray rate due to temperature and ambient pressure to be reduced.

In addition, by making L/d less than 1, the fuel is separated at the inlet portions of the first spraying apertures 21*a* and effective L/d is further reduced, and fuel does not fill the first spraying apertures 21*a* even under high temperature and negative pressure, reducing the influence of pressure loss due to gas-liquid two-phase flow, which has the effect of enabling reductions in changes in spray rate due to temperature and ambient pressure.

Furthermore, because the dead volume is reduced, the amount of fuel evaporation inside the dead volume under high temperature and negative pressure during cessation of spraying is also reduced, reducing changes in spray rate (static flow rate and dynamic flow rate) that accompany changes in temperature and ambient pressure.

Methods in which a strip-shaped hoop material is fed and pressed progressively are often used as methods for machining the first spraying aperture plate 21 in order to machine precisely at reduced cost. However, if the plate thickness of the first spraying aperture plate 21, i.e., the sheet thickness of the hoop material, is reduced such that L/d is reduced with the aim of suppressing changes in spray rate due to changes in ambient pressure and the aim of atomization, then there may be insufficient rigidity, and one problem has been that wrinkles form in the hoop material as the hoop material is fed progressively, preventing progressive feeding to the correct position, and giving rise to processing problems.

In answer to that, in Embodiment 1, because a thin portion 21*c* is disposed only on a central portion of the first spraying aperture plate 21 and the first spraying apertures 21*a* are disposed on that thin portion 21*c*, L/d of the first spraying apertures 21*a* can be reduced while ensuring rigidity using a thick portion 21*b* around the circumference of the thin portion 21*c*. Consequently, changes in spray rate due to temperature and ambient pressure can be reduced while maintaining high productivity at reduced cost.

In addition, as a result of taking macrophotographs of fuel that is sprayed from the spraying apertures 5, in order to uncover the atomization mechanism of the fuel spray, it has been found that in the fuel breakup process the fuel changes from a liquid film to liquid threads and then to liquid droplets as it breaks up due to forces that act to disperse the fuel overcoming surface tension. Furthermore, it has also been found that once liquid droplets form, breaking up is less likely thereafter because the influence of the surface tension is increased.

In other words, spraying the fuel from the spraying apertures 5 as a thin liquid film that has reduced turbulence and breaking that liquid film up after spreading it even thinner results in finer atomization. Conversely, if turbulence arises in the fuel flow, the liquid droplets are bigger after breaking up because the liquid fuel film breaks up as a thick liquid film before it can spread out thinly.

In answer to that, in Embodiment 1, generation of turbulence in the flow 18*a* of fuel over the seat surface 3*a* toward the first spraying apertures 21*a* is suppressed by joining the thin portion 21*c* and the thick portion 21*b* by the tapered portion 21*d*. Because of that, the fuel collides with the inner wall on one side of the second spraying aperture 22*a*, and is then widened by the inner wall of the second spraying apertures 22*a* into a thin liquid film that has reduced turbulence and is then sprayed, enabling a high atomization effect to be achieved.

Furthermore, in Embodiment 1, because the first spraying apertures 21*a* are made cylindrical, the flow channel cross-sectional area of the first spraying apertures 21*a* does not change in the axial direction, enabling irregularities in inlet opening area to be reduced when the first spraying apertures 21*a* is machined, thereby enabling irregularities in spray rate to be reduced.

Because the second spraying apertures 22*a* are made cylindrical, the flow channel cross-sectional area of the second spraying apertures 22*a* does not change in the axial direction, and irregularities are less likely to occur in the flow as the liquid film stretches over the inner walls of the second spraying apertures 22*a*, thereby enabling irregularities in the spray shape of the fuel that is sprayed from the spraying apertures 5 to be reduced.

In addition, in Embodiment 1, when machining the first spraying aperture plate 21, a pilot aperture for positioning relative to the pressing die is disposed on the hoop material, and the first spraying apertures 21*a* are press-formed relative to this pilot aperture. The positioning apertures 21 e are also press-formed relative to the pilot aperture.

When machining the second spraying aperture plate 22, a pilot aperture for positioning relative to the pressing die is also disposed on the hoop material, and the second spraying apertures 22*a* and the half-blanked portions 22*b* are press-formed relative to this pilot aperture. Positioning precision between the first spraying aperture plate 21 and the second spraying aperture plate 22 is improved by fitting the half-blanked portions 22*b* into the positioning apertures 21*e*, enabling irregularities in spray shape to be reduced.

In addition, in Embodiment 1, because the first weld portion 4*a* is disposed nearer to the valve seat central axis 3*c* than the positioning interfitting portions (the positioning apertures 21*e* and the half-blanked portions 22*b*), the construction is such that fuel does not leak externally.

Embodiment 2

Figure 6:
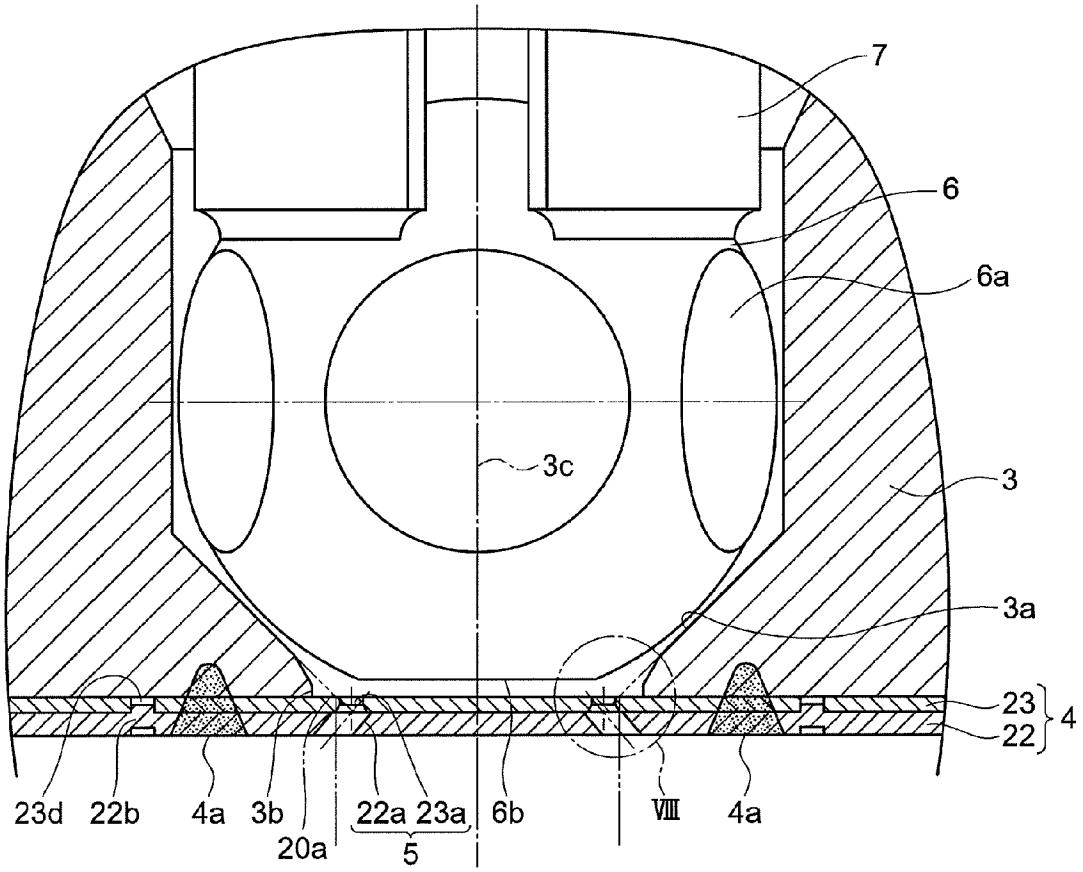
FIG. 6 is a cross section that shows a valve seat, a spraying aperture plate, and a ball of a fuel injection valve according to Embodiment 2 of the present invention enlarged.
Figure 7:
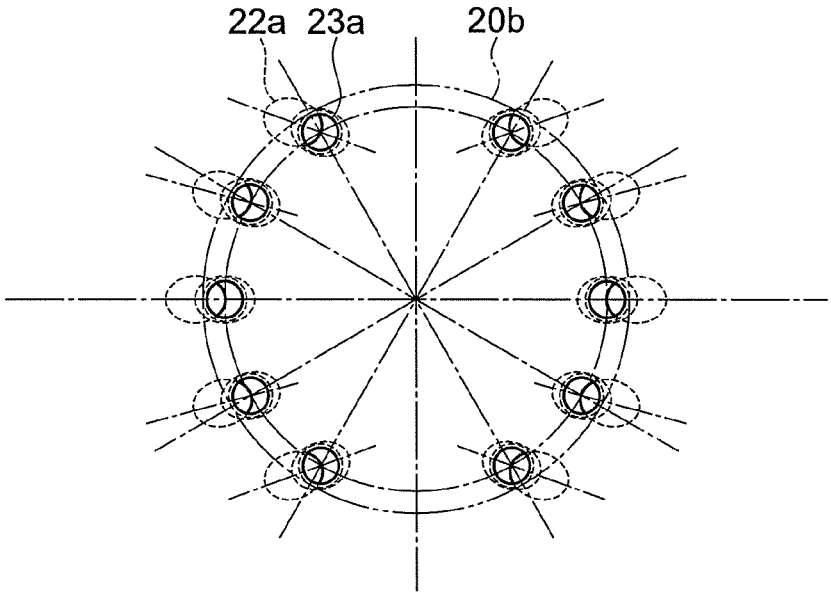
FIG. 7 is a plan that shows a central portion of the spraying aperture plate from FIG. 6.
Figure 8:
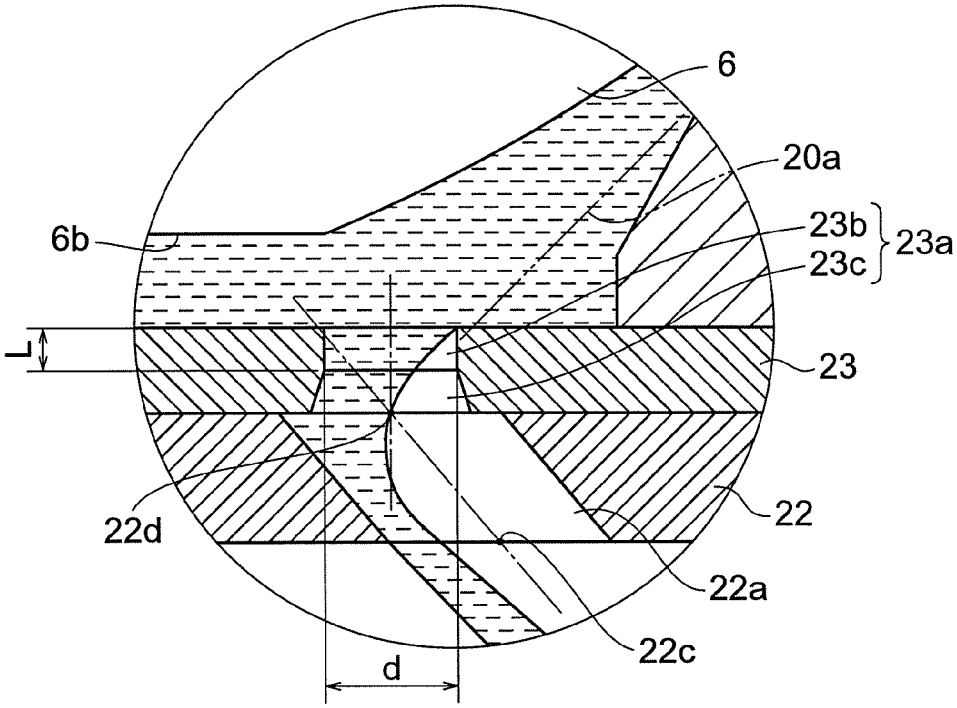
FIG. 8 is a cross section that shows Portion VIII from FIG. 6 enlarged.

Next, FIG. 6 is a cross section that shows a valve seat 3, a spraying aperture plate 4, and a ball 6 of a fuel injection valve according to Embodiment 2 of the present invention enlarged, FIG. 7 is a plan that shows a central portion of the spraying aperture plate 4 from FIG. 6, and FIG. 8 is a cross section that shows Portion VIII from FIG. 6 enlarged.

In Embodiment 1, the thin portion 21*c* is disposed on the first spraying aperture plate 21, but in Embodiment 2, a first spraying aperture plate 23 is used in which a thin portion 21*c* is not disposed, and in which plate thickness is uniform. A spraying aperture plate 4 is configured by laminating the first spraying aperture plate 23 and a second spraying aperture plate 22 that is similar or identical to that of Embodiment 1.

A plurality of first spraying apertures 23*a* are disposed on the first spraying aperture plate 23. Respective spraying apertures 5 are constituted by the first spraying apertures 23*a* and second spraying apertures 22*a*. Each of the first spraying apertures 23*a* is constituted by: a cylinder portion 23*b* in which flow channel cross-sectional area is constant over an entire longitudinal direction; and a flow channel enlarged portion 23*c* that is adjacent downstream from the cylinder portion 23*b*, and in which flow channel cross-sectional area is enlarged gradually downstream (FIG. 8).

Inlet portions of the first spraying apertures 23*a* (inlet portions of the cylinder portions 23*b*) are disposed nearer to a valve seat central axis 3*c* than a valve seat opening 3*b*, where the inside diameter of the valve seat 3 is smallest, and in Embodiment 2, are disposed inside the imaginary circle 20*b*. The flow channel enlarged portion 23*c* has a truncated cone shape. A truncated cone is a shape in which a cone is cut in a plane that is parallel to a base plane, and a small cone portion is removed.

A plurality of positioning apertures 23*d* with which half-blanked portions 22*b* fit together are press-formed into the first spraying aperture plate 23. The second spraying aperture plate 22 is positioned relative to the first spraying aperture plate 23 by fitting the half-blanked portions 22*b* into the positioning apertures 23*d*.

An aperture area of outlet portions of the first spraying apertures 23*a* (outlet portions of the flow channel enlarged portion 23*c*) is smaller than an aperture area of inlet portions of the second spraying apertures 22*a*. In other words, the aperture area of the inlet portions of the second spraying apertures 22*a* is larger than the aperture area of the outlet portions of the first spraying apertures 23*a*. The second spraying apertures 22*a* are disposed such that inlet opening edges thereof do not cross the outlet opening edges of the first spraying apertures 23*a*. In other words, outlet openings of the first spraying apertures 23*a* are disposed wholly inside inlet openings of the second spraying apertures 22*a*.

An axial length L of the cylinder portions 23*b*, which are the smallest flow channel diameter portions of the first spraying apertures 23*a*, is approximately half of an overall longitudinal dimension of the first spraying apertures 23*a*, and is less than a diameter d of the cylinder portions 23*b* ($L/d<1$). The rest of the configuration is similar or identical to that of Embodiment 1.

In a fuel injection valve of this kind, because each of the first spraying apertures 23*a* is constituted by a cylinder portion 23*b* and a flow channel enlarged portion 23*c*, the spraying aperture length L of the smallest flow channel diameter d of the first spraying apertures 23*a* can be reduced without reducing the plate thickness of the first spraying aperture plate 23. Because of that, L/d can be reduced while ensuring enough plate rigidity to be suitable for progressive pressing using a hoop material. Consequently, fuel does not fill the first spraying apertures 23*a* even under high temperature and negative pressure, reducing the influence of pressure loss due to gas-liquid two-phase flow, which has the effect of enabling reductions in changes in spray rate due to temperature and ambient pressure at low cost.

Figure 9:
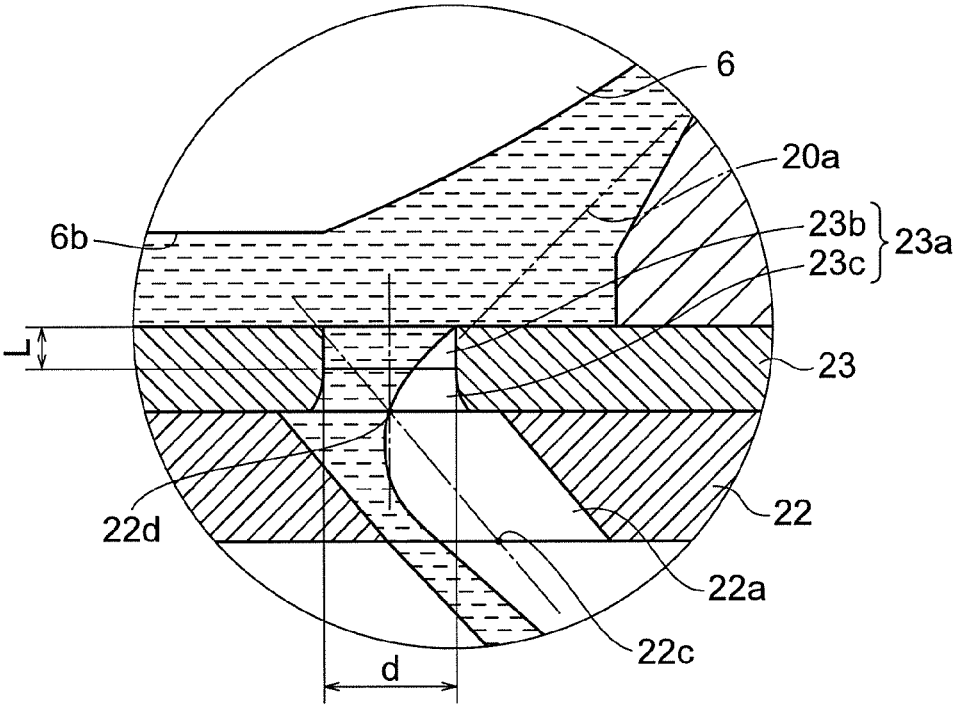
FIG. 9 is a cross section that shows a variation of a flow channel expanded portion from FIG. 8.

Moreover, in Embodiment 2, the flow channel enlarged portion 23*c* has a truncated cone shape, but may be made to have a horn-shaped cross section, as shown in FIG. 9, for example.

Embodiment 3

Figure 10:
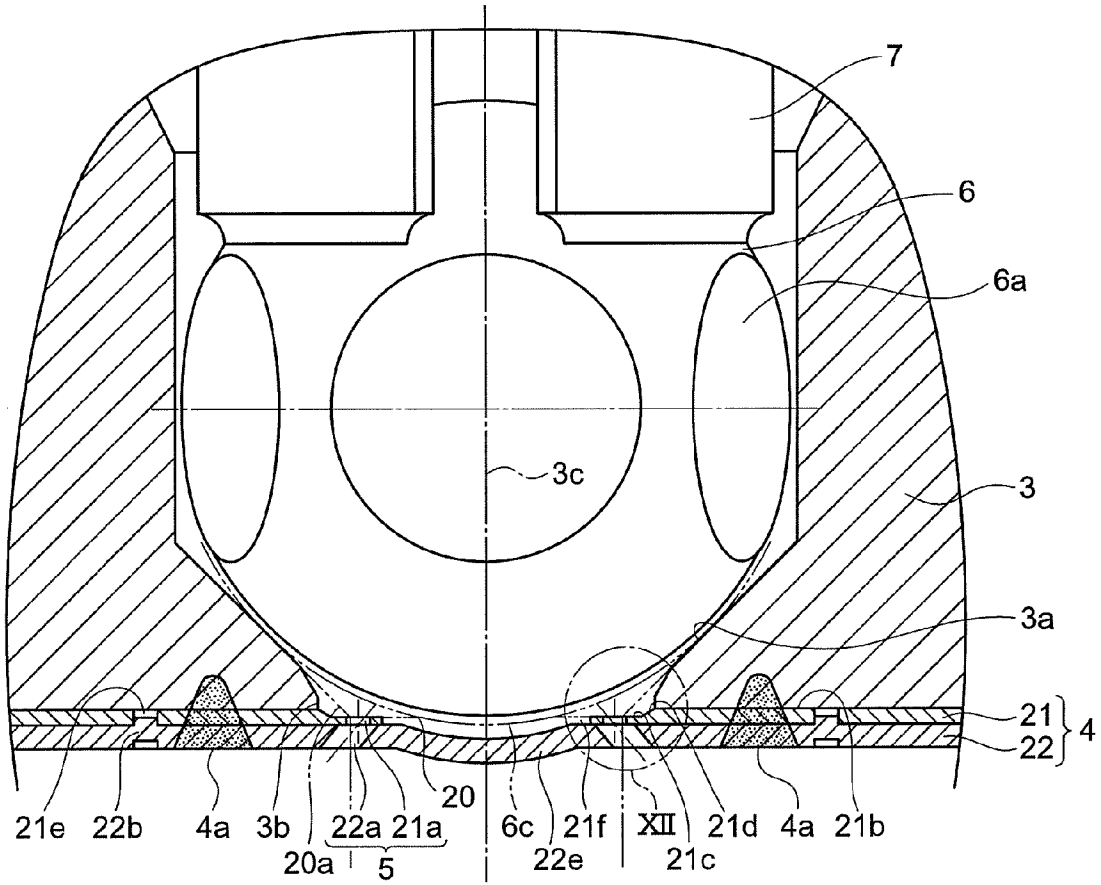
FIG. 10 is a cross section that shows a valve seat, a spraying aperture plate, and a ball of a fuel injection valve according to Embodiment 3 of the present invention enlarged.
Figure 11:
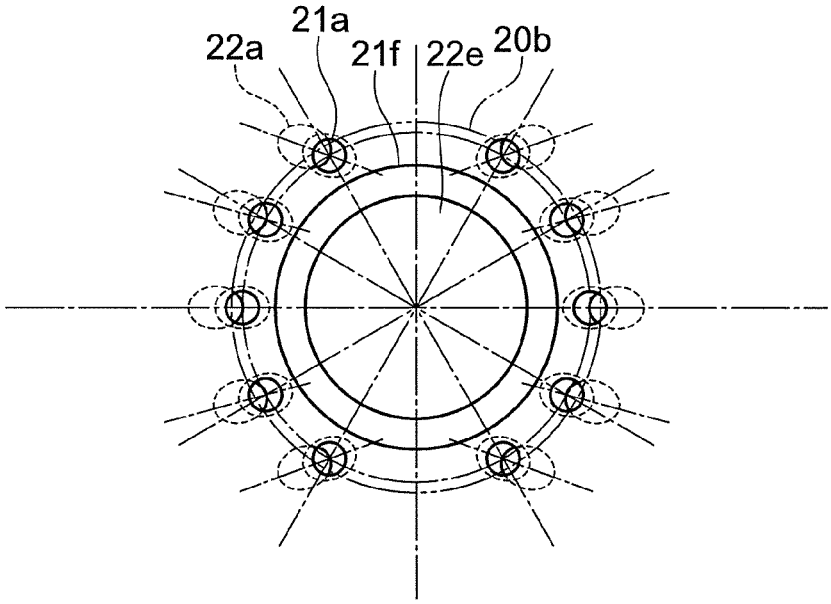
FIG. 11 is a plan that shows a central portion of the spraying aperture plate from FIG. 10.
Figure 12:
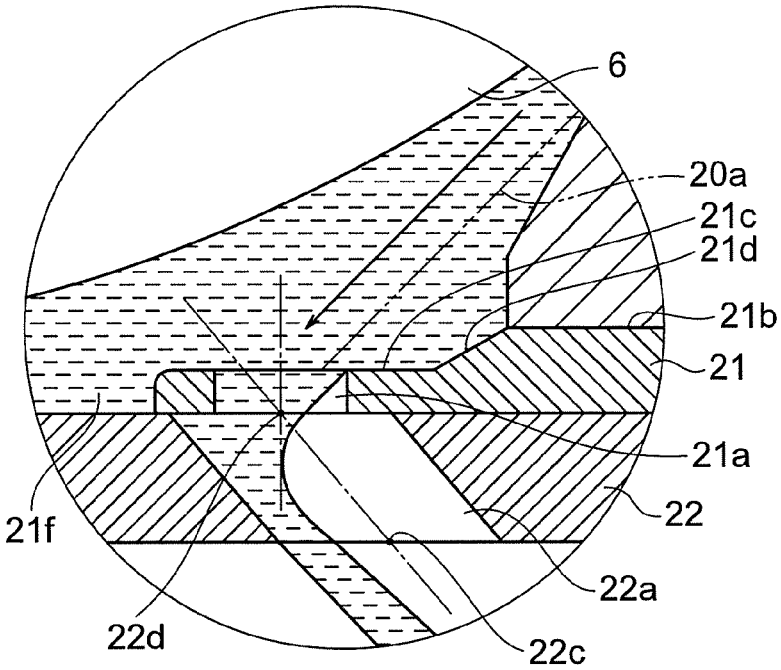
FIG. 12 is a cross section that shows Portion XII from FIG. 10 enlarged.

Next, FIG. 10 is a cross section that shows a valve seat 3, a spraying aperture plate 4, and a ball 6 of a fuel injection valve according to Embodiment 3 of the present invention enlarged, FIG. 11 is a plan that shows a central portion of the spraying aperture plate 4 from FIG. 10, and FIG. 12 is a cross section that shows Portion XII from FIG. 10 enlarged.

In Embodiment 1, the flat portion 6*b* is disposed on the tip end portion of the ball 6, but in Embodiment 3, a tip end portion of a ball 6 if left as a spherical surface without a flat portion 6*b* being disposed. At the same time, a circular plate opening 21*f* for avoiding interference with the tip end portion of the ball 6 during valve closing is disposed on a thin portion 21*c* of a first spraying aperture plate 21 according to Embodiment 3. The plate opening 21*f* is disposed so as to be coaxial with the valve seat central axis 3*c*.

In FIG. 10, a tip end surface 6*c* of the ball 6 during valve closing is inside the plate opening 21*f*, and intersects with a plane that contains an upstream end surface of the thin portion 21*c* at an imaginary circle 20*c*. First spraying apertures 21*a* are all disposed on the thin portion 21*c* radially outside the plate opening 21*f*.

A convex portion 22*e* that is curved so as to protrude downstream is disposed centrally on a portion of the second spraying aperture plate 22 that faces the plate opening 21*f*. The rest of the configuration is similar or identical to that of Embodiment 1.

In a fuel injection valve of this kind, because dead volume can be reduced in a portion that is surrounded by the inner walls of the valve seat 3 downstream from the seat surface 3*a*, the upstream end surface of the first spraying aperture plate 21, and the tip end portion of the ball 6, while avoiding interference between the tip end portion of the ball 6 and the spraying aperture plate 4 during valve closing, the spray rate of initial spray that has a larger particle size is reduced, enabling the overall spray particle size of initial spray and steady spray combined to be reduced.

The amount of fuel evaporation inside the dead volume under high temperature and negative pressure during cessation of spraying is also reduced, reducing changes in spray rate (static flow rate and dynamic flow rate) that accompany changes in temperature and ambient pressure.

Moreover, a plate opening and a convex portion such as those shown in Embodiment 3 may respectively be disposed on the first spraying aperture plate 23 and the second spraying aperture plate 22 according to Embodiment 2.

Embodiment 4

Figure 13:
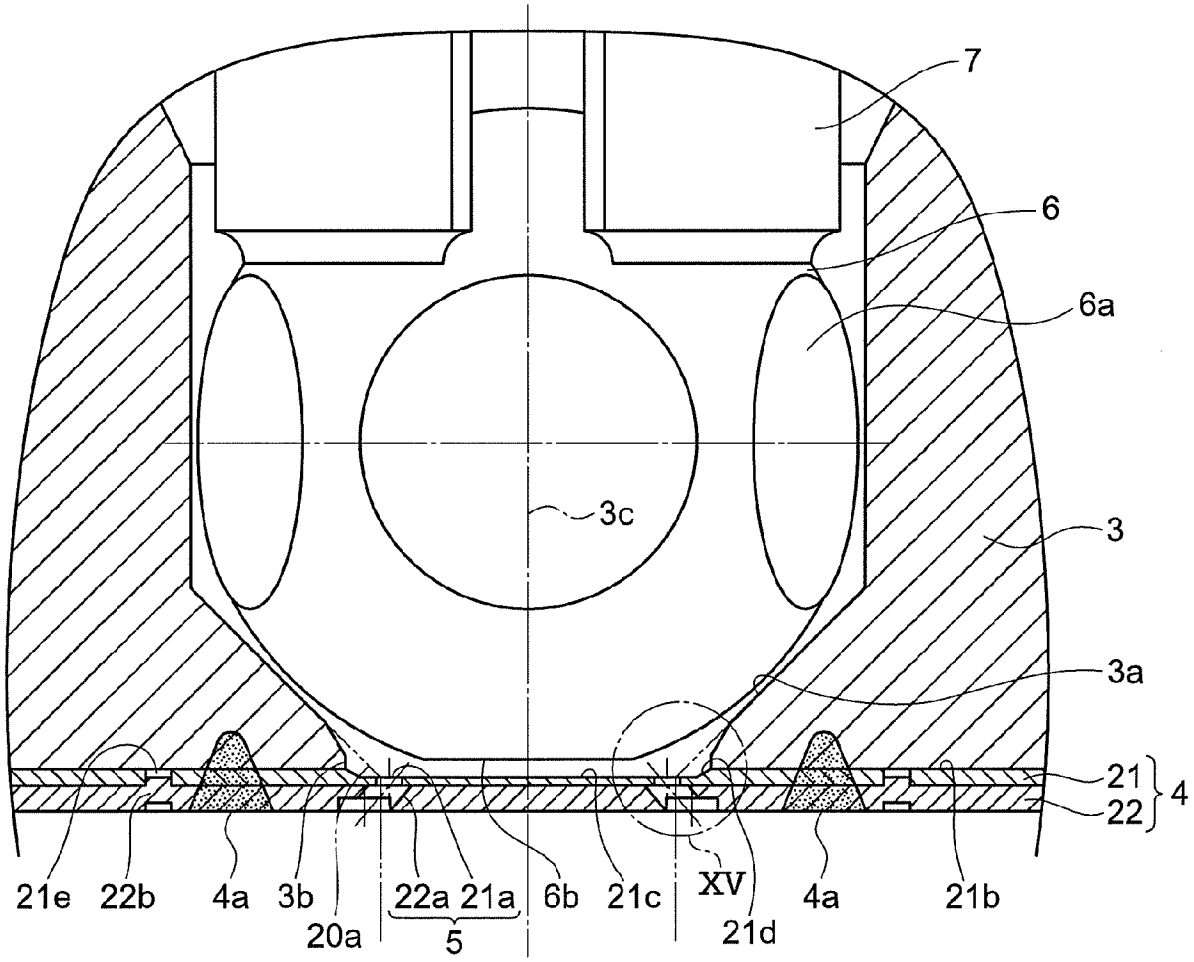
FIG. 13 is a cross section that shows a valve seat, a spraying aperture plate, and a ball of a fuel injection valve according to Embodiment 4 of the present invention enlarged.
Figure 14:
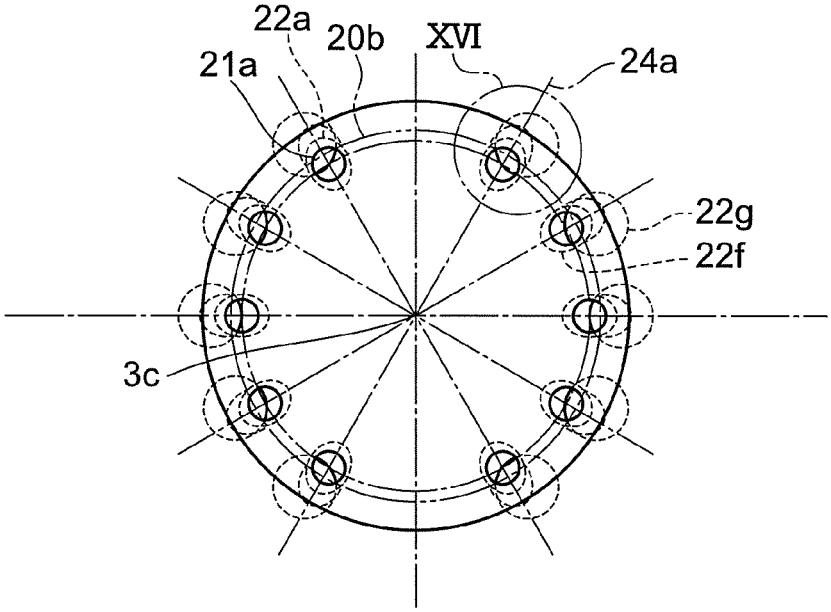
FIG. 14 is a plan that shows a central portion of the spraying aperture plate from FIG. 13.
Figure 15:
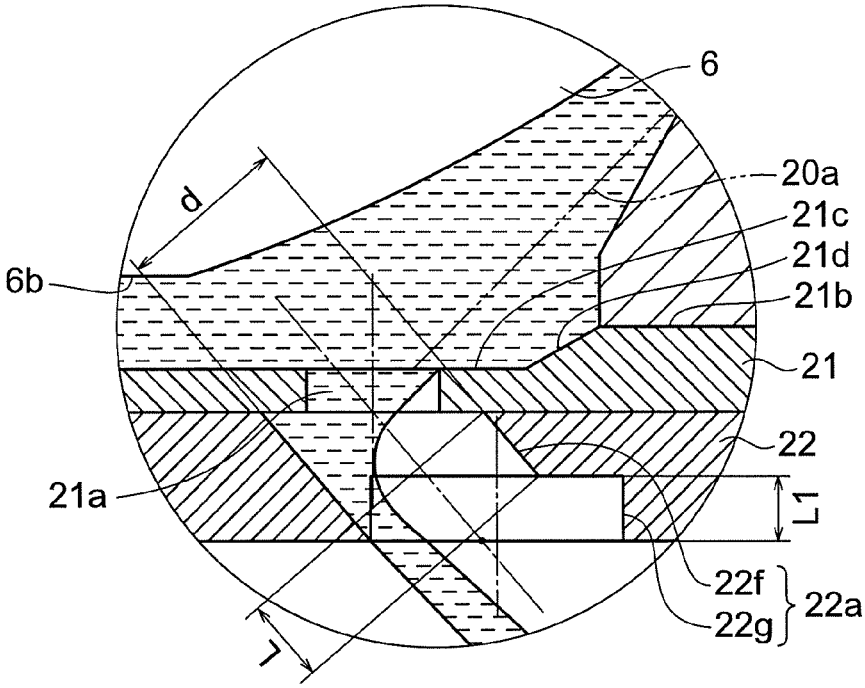
FIG. 15 is a cross section that shows Portion XV from FIG. 13 enlarged.
Figure 16:
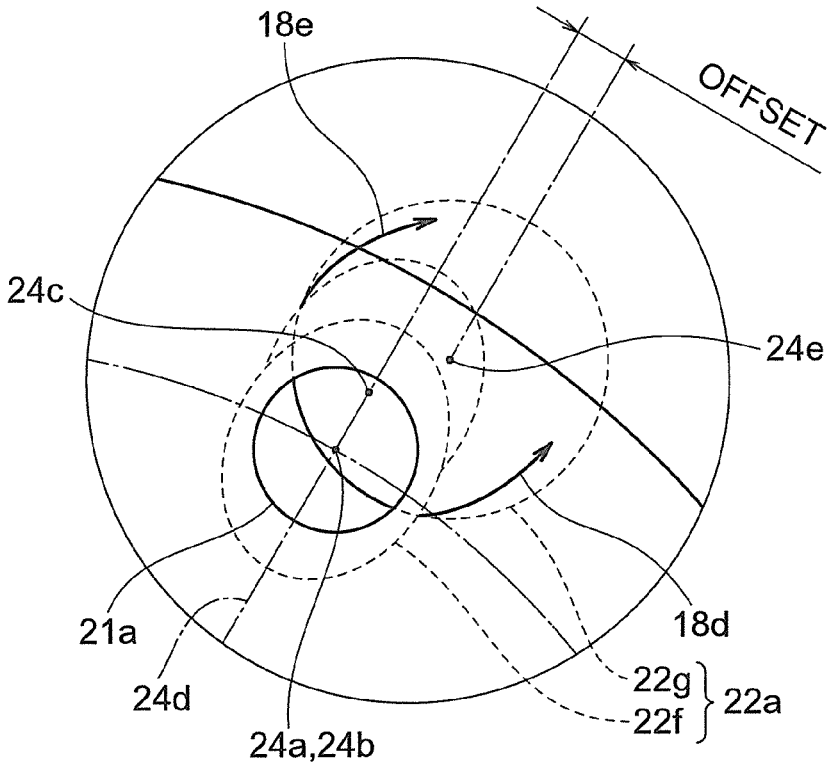
FIG. 16 is a plan that shows Portion XVI from FIG. 14 enlarged.

FIG. 13 is a cross section that shows a valve seat 3, a spraying aperture plate 4, and a ball 6 of a fuel injection valve according to Embodiment 4 of the present invention enlarged, FIG. 14 is a plan that shows a central portion of the spraying aperture plate 4 from FIG. 13, FIG. 15 is a cross section that shows Portion XV from FIG. 13 enlarged, and FIG. 16 is a plan that shows Portion XVI from FIG. 14 enlarged.

Second spraying apertures 22*a* according to Embodiment 4 are each constituted by: a spraying aperture main body 22*f*; and a large diameter portion 22*g* that constitutes an outlet of the second spraying apertures 22*a* that is adjacent downstream from the spraying aperture main body 22*f*. The spraying aperture main bodies 22*f* are inclined relative to first spraying apertures 21*a* in a similar manner to the second spraying apertures 22*a* according to Embodiment 1. In other words, the spraying aperture main bodies 22*f* are inclined so as to be positioned further outward in a radial direction of a second spraying aperture plate 22 progressively downstream.

Diameters of large diameter portions 22*g* are larger than diameters of the spraying aperture main bodies 22*f*. The large diameter portions 22*g* are cylinders that are centered around an axis that is perpendicular to the second spraying aperture plate 22.

Inlet centers 24*a* of the first spraying apertures 21*a*, inlet centers 24*b* of the second spraying apertures 22*a*, and outlet centers 24*c* of the spraying aperture main bodies 22*f* are respectively disposed so as to be lined up in radial straight lines 24*d* that pass through the valve seat central axis 3*c* when each is projected perpendicularly onto a plane that is perpendicular to the valve seat central axis 3*c*.

Centers 24*e* of the large diameter portions 22*g* are further away from the valve seat central axis 3*c* than the outlet centers 24*c* of the spraying aperture main bodies 22*f*, and are offset in a desired direction of spraying relative to the straight lines 24*d*, when projected perpendicularly onto the above-mentioned plane. The rest of the configuration is similar or identical to that of Embodiment 1.

In a fuel injection valve of this kind, when the fuel flow that has separated at the inlet portions of the first spraying apertures 21*a* is projected perpendicularly onto a plane that is perpendicular to the valve seat central axis 3*c*, the fuel flow is a flow toward the valve seat central axis 3*c*. When the second spraying apertures 22*a* that are inclined radially outward are projected perpendicularly onto the above-mentioned plane, the spraying aperture main bodies 22*f* are oriented in a radial pattern from the valve seat central axis, and the fuel flow and the direction of the spraying aperture main bodies 22*f* oppose each other directly in the above-mentioned plane.

Because of that, the flow that starts to spread into a liquid film on the inner walls of the second spraying apertures 22*a*, which have a larger flow channel cross-sectional area than the first spraying apertures 21*a*, is augmented, enabling a thin film of fuel to be formed efficiently, which has an atomizing effect.

In addition, because the direction of flow is changed along the curvature of the spraying aperture inner walls as the liquid fuel film that spreads out over the inner walls of the second spraying apertures 22*a* moves downstream, the individual spraying angles that are sprayed from each spraying aperture outlet portion are affected by L/d of the second spraying apertures 22*a*. In other words, if L/d of the second spraying apertures 22*a* is reduced, the individual spraying angles are large, and if L/d of the second spraying apertures 22*a* is increased, the individual spraying angles can be reduced.

However, if the second spraying apertures 22*a* are wholly oriented in a radial pattern from the valve seat central axis 3*c* when the second spraying apertures 22*a* are projected perpendicularly onto the above-mentioned plane, then the direction of spraying cannot be freely aimed.

In answer to that, in Embodiment 4, L/d is reduced in the desired direction of spraying by disposing large diameter portions 22*g* at outlet portions in the second spraying apertures 22*a* and by also offsetting the centers 24*d* of the large diameter portions 22*g* from the straight lines 24*d*. L/d is also optimized by adjusting a length (depth) dimension L1 of the large diameter portions 22*g*.

Thus, of two ends of the liquid fuel film that spreads out over the inner walls of the second spraying apertures 22*a*, by changing the direction of flow of the end of the liquid film that is nearer to the desired direction of spraying along the curvature of the spraying aperture inner wall as it moves downstream, the liquid film can be ejected from the second spraying apertures 22*a* at a point at which it is oriented in the desired direction of spraying 18*d*.

Furthermore, because there is no large diameter portion 22*g* at the end of the liquid film that is further away from the desired direction of spraying, and L/d is large, the direction of flow along the curvature of the spraying aperture inner wall can be changed to the desired direction of spraying 18*e* as the liquid fuel film moves downstream. Because of that, improvements in both atomization and freedom in the direction of spraying can be achieved.

Moreover, if the desired directions of spraying are aligned with the straight lines 24*d*, then centers 24*e* of the large diameter portions 22*g* need only be further away from the valve seat central axis 3*c* than the outlet centers 24*c* of the spraying aperture main bodies 22*f*, and do not need to be offset relative to the straight lines 24*d*.

In Embodiments 1 through 4, the positioning apertures 21*e* or 23*d* are disposed on the first spraying aperture plates 21 or 23, and the half-blanked portions 22*b* are disposed on the second spraying aperture plate 22, but that may also be reversed.

The invention claimed is:

1. A fuel injection valve comprising:

a valve seat including:

a seat surface that is inclined such that a diameter is gradually reduced downstream; and a valve seat opening that is disposed downstream from the seat surface;

a valve body that is placed in contact with the seat surface to stop outflow of fuel from the valve seat opening, and that is separated from the seat surface to allow outflow of fuel from the valve seat opening; and a spraying aperture plate that is fixed to a downstream end surface of the valve seat, and that includes a plurality of spraying apertures that externally spray fuel that flows out of the valve seat opening, wherein:

the spraying aperture plate is disposed such that an imaginary circular conical surface that is a downstream extension of the seat surface and an upstream end surface of the spraying aperture plate intersect to form an imaginary circle;

the spraying aperture plate is configured by laminating an upstream first spraying aperture plate and a downstream second spraying aperture plate;

a thin portion that is formed so as to make a downstream hollow in an upstream end surface of the first spraying aperture plate is disposed on a portion of the first spraying aperture plate that faces into the valve seat opening;

a plurality of first spraying apertures that constitute upstream portions of the spraying apertures are disposed on the thin portion;

a plurality of second spraying apertures that constitute downstream portions of the spraying apertures are disposed on the second spraying aperture plate;

the first spraying apertures are perpendicular to the first spraying aperture plate;

L/d of the first spraying apertures is less than 1, where L is axial length, and d is diameter;

the second spraying apertures are inclined at a predetermined angle relative to an axis that is perpendicular to the second spraying aperture plate;

when the second spraying apertures are projected perpendicularly onto a plane that is perpendicular to a central axis of the valve seat, a center of an outlet portion of the second spraying apertures in the plane is disposed further away from the central axis of the valve seat than a center of an inlet portion of the second spraying apertures;

an aperture area of an outlet portion of the first spraying apertures is smaller than an aperture area of the inlet portion of the second spraying apertures; and an entire outlet opening of the first spraying apertures is disposed inside an inlet opening of the second spraying apertures.

2. The fuel injection valve according to claim 1, wherein the first spraying apertures and the second spraying apertures are each cylindrical.

3. A fuel injection valve comprising:

a valve seat including:

a seat surface that is inclined such that a diameter is gradually reduced downstream; and a valve seat opening that is disposed downstream from the seat surface;

a valve body that is placed in contact with the seat surface to stop outflow of fuel from the valve seat opening, and that is separated from the seat surface to allow outflow of fuel from the valve seat opening; and a spraying aperture plate that is fixed to a downstream end surface of the valve seat, and that includes a plurality of spraying apertures that externally spray fuel that flows out of the valve seat opening, wherein:

the spraying aperture plate is disposed such that an imaginary circular conical surface that is a downstream extension of the seat surface and an upstream end surface of the spraying aperture plate intersect to form an imaginary circle;

the spraying aperture plate is configured by laminating an upstream first spraying aperture plate and a downstream second spraying aperture plate;

a plurality of first spraying apertures that constitute upstream portions of the spraying apertures are disposed on the first spraying aperture plate, and an inlet portion of the first spraying apertures is disposed nearer to a central axis of the valve seat than the valve seat opening, where a diameter is smallest in the valve seat;

a plurality of second spraying apertures that constitute downstream portions of the spraying apertures are disposed on the second spraying aperture plate;

the first spraying apertures are constituted by:

a cylinder portion in which flow channel cross-sectional area is constant over an entire longitudinal direction; and a flow channel enlarged portion that is adjacent downstream from the cylinder portion, and in which flow channel cross-sectional area is enlarged gradually downstream;

L/d of the first spraying apertures is less than 1, where L is axial length, and d is diameter;

the second spraying apertures are inclined at a predetermined angle relative to an axis that is perpendicular to the second spraying aperture plate;

when the second spraying apertures are projected perpendicularly onto a plane that is perpendicular to a central axis of the valve seat, a center of an outlet portion of the second spraying apertures in the plane is disposed further away from the central axis of the valve seat than a center of an inlet portion of the second spraying apertures;

an aperture area of an outlet portion of the first spraying apertures is smaller than an aperture area of the inlet portion of the second spraying apertures; and an entire outlet opening of the first spraying apertures is disposed inside an inlet opening of the second spraying apertures.

4. The fuel injection valve according to claim 1, wherein:

a plate opening for avoiding interference with a tip end portion of the valve body during valve closing is disposed on the first spraying aperture plate; and a convex portion that is curved so as to protrude downstream is disposed on a portion of the second spraying aperture plate that faces the plate opening.

5. The fuel injection valve according to claim 1, wherein:

the second spraying apertures are constituted by:

a spraying aperture main body; and a large diameter portion that is adjacent downstream from the spraying aperture main body, and that constitutes an outlet of the second spraying apertures;

a diameter of the large diameter portions is formed so as to be greater than a diameter of the spraying aperture main bodies; and when the spraying apertures are projected perpendicularly onto a plane that is perpendicular to the central axis of the valve seat, an inlet center of the first spraying apertures, an inlet center of the second spraying apertures, and an outlet center of the spraying aperture main bodies are respectively disposed so as to line up in a radial straight line that passes through the central axis of the valve seat, and a center of the large diameter portions is offset relative to the straight line.

6. The fuel injection valve according to claim 1, wherein:

a positioning aperture is disposed on a first of the first spraying aperture plate and the second spraying aperture plate; and a half-blanked portion that is fitted together with the positioning aperture is disposed on a second of the first spraying aperture plate and the second spraying aperture plate.

7. The fuel injection valve according to claim 3, wherein:

a plate opening for avoiding interference with a tip end portion of the valve body during valve closing is disposed on the first spraying aperture plate; and a convex portion that is curved so as to protrude downstream is disposed on a portion of the second spraying aperture plate that faces the plate opening.

8. The fuel injection valve according to claim 3, wherein:

the second spraying apertures are constituted by:

a spraying aperture main body; and a large diameter portion that is adjacent downstream from the spraying aperture main body, and that constitutes an outlet of the second spraying apertures;

a diameter of the large diameter portions is formed so as to be greater than a diameter of the spraying aperture main bodies; and when the spraying apertures are projected perpendicularly onto a plane that is perpendicular to the central axis of the valve seat, an inlet center of the first spraying apertures, an inlet center of the second spraying apertures, and an outlet center of the spraying aperture main bodies are respectively disposed so as to line up in a radial straight line that passes through the central axis of the valve seat, and a center of the large diameter portions is offset relative to the straight line.

9. The fuel injection valve according to claim 3, wherein:

a positioning aperture is disposed on a first of the first spraying aperture plate and the second spraying aperture plate; and a half-blanked portion that is fitted together with the positioning aperture is disposed on a second of the first spraying aperture plate and the second spraying aperture plate.

* * * * *